US008429788B1

(12) United States Patent
Lovelady et al.

(10) Patent No.: US 8,429,788 B1
(45) Date of Patent: Apr. 30, 2013

(54) LIQUID SEPARATION DEVICE FOR SUCTION NOZZLES

(75) Inventors: Gary L. Lovelady, Moresville, IN (US); Kenneth L. Burt, Carlsbad, CA (US)

(73) Assignee: Creative Marketing Strategies Inc., Carlsbad, CA (US)

( * ) Notice: Subject to any disclaimer, the term of this patent is extended or adjusted under 35 U.S.C. 154(b) by 1107 days.

(21) Appl. No.: 12/378,451

(22) Filed: Feb. 13, 2009

Related U.S. Application Data

(63) Continuation-in-part of application No. 11/230,350, filed on Sep. 19, 2005, now abandoned.

(60) Provisional application No. 60/610,690, filed on Sep. 17, 2004.

(51) Int. Cl.
*A47L 9/20* (2006.01)

(52) U.S. Cl.
USPC ..... 15/320; 15/353

(58) Field of Classification Search ..... 15/320–322, 15/353; *A47L 9/20*
See application file for complete search history.

(56) References Cited

U.S. PATENT DOCUMENTS

| | | | |
|---|---|---|---|
| 1,014,027 | A | 1/1912 | Walter |
| 1,454,381 | A | 5/1923 | Stepp |
| 2,617,138 | A | 12/1948 | Brown, Sr. et al. |
| 2,635,277 | A | 4/1953 | Belknap |
| 3,267,511 | A | 8/1966 | Meyerhoefer |
| 3,616,482 | A | 11/1971 | Brycki |
| 3,771,577 | A | 11/1973 | Mayer |
| 4,041,569 | A | 8/1977 | Petersen |
| 4,055,405 | A | 10/1977 | Thun-Hohenstein |
| 4,179,769 | A | 12/1979 | Lundquist |
| 4,189,098 | A | 2/1980 | Wagner et al. |
| 4,216,563 | A | 8/1980 | Cyphert |
| 4,226,000 | A | 10/1980 | Tribolet |
| 4,287,635 | A | 9/1981 | Jacobs |
| 4,329,756 | A | 5/1982 | Chicoine et al. |
| 4,335,486 | A | 6/1982 | Kochte |
| 4,341,540 | A | 7/1982 | Howerin |
| 4,476,608 | A | 10/1984 | Rasmussen |
| 4,675,936 | A | 6/1987 | Rawlins |
| 4,788,738 | A | 12/1988 | Monson et al. |
| 4,798,613 | A | 1/1989 | Hetherington et al. |
| 4,841,595 | A | 6/1989 | Wiese |
| 4,847,943 | A | 7/1989 | Blase et al. |
| 4,887,330 | A | 12/1989 | Woodhall et al. |
| 4,930,178 | A | 6/1990 | Monson et al. |
| 4,934,021 | A | 6/1990 | Lenting |
| 4,955,104 | A | 9/1990 | Miller |
| 5,103,526 | A | 4/1992 | Berfield |
| 5,105,504 | A | 4/1992 | Brzoska |
| 5,109,562 | A | 5/1992 | Albrecht |
| 5,263,224 | A | 11/1993 | Lovelady |
| 5,484,402 | A | 1/1996 | Saravia et al. |
| 5,485,652 | A | 1/1996 | Holland |
| 5,507,068 | A | 4/1996 | Fan et al. |
| 6,021,545 | A | 2/2000 | Delgado et al. |

(Continued)

*Primary Examiner* — David Redding
(74) *Attorney, Agent, or Firm* — Todd N. Hathaway

(57) ABSTRACT

A liquid separation nozzle utilized with a suction source, such as a vacuum cleaner. Liquid and air are drawn through an intake by the suction, and pass through a plurality of liquid separation passages. The liquid separation passages divide the flow and separate the liquid from the air. The liquid drops out from the separation passages and accumulates in the bottom of the collection tank, while the air is drawn out through the upper part of the tank. A float valve prevents liquid from being drawn out with the air as the tank becomes full.

20 Claims, 17 Drawing Sheets

U.S. PATENT DOCUMENTS 6,203,321 B1 3/2001 Helmer et al.
6,213,970 B1 4/2001 Nelson et al.
6,623,445 B1 9/2003 Nelson et al.
6,658,693 B1 12/2003 Reed, Jr.
6,687,952 B1 2/2004 Mohan, Jr.
6,725,500 B2 4/2004 Allen et al.
6,968,593 B1 11/2005 Lenkiewicz et al.

LIQUID SEPARATION DEVICE FOR SUCTION NOZZLES

This is a continuation-in-part application of patent application Ser. No. 11/230,350, entitled "Liquid Separation Device for Suction Nozzles", which was filed Sep. 19, 2005 now abandoned, which claimed the benefit of U.S. provisional application Ser. No. 60/610,690, filed Sep. 17, 2004.

BACKGROUND OF THE INVENTION a. Field of the Invention

The present invention relates generally to an apparatus for lifting liquids from a floor or other surface, and, more particularly, to a suction-operated extraction device that can vacuum up a liquid while preventing the liquid from being drawn into the suction generator.

b. Background Art

A variety of suction powered devices have been developed for lifting a liquid from a surface, such as lifting a spill from a carpet or other floor surface, for example. In general, it is undesirable for the liquid to pass through to the motor or other device that generates the suction, which is typically designed to handle only air. Accordingly, a persistent problem is effectively separating the liquid from the air prior to the flow reaching the suction generator.

U.S. Pat. No. 5,263,224 discloses a wet vacuum attachment for vacuum cleaners that is designed to be attached to the end of a vacuum hose, in order to remove and separate fluid so that the fluid does not enter the vacuum unit. The attachment has a housing with an outlet that can be coupled to the vacuum hose, and an inlet that can engage a working surface to remove the fluid with an air stream created by the vacuum unit. Attached to the housing is a tank that stores the fluid as it is removed from the working surface. Within the tank is a first passage that provides communication between the housing inlet and the tank, and a second passage that provides communication from the tank to the housing outlet. Located in front of the first passage is a wall that deflects the fluid down into the tank, while the air flows into the second passage.

The present invention is directed to improvements in such devices. For example, the ability of the device of the '224 patent to separate a liquid such as water from the airflow was less than desirable, with the result that more moisture than desired would be carried back through the hose to the vacuum cleaner itself. Furthermore, the operation was not automatic, but rather required the operation of a trigger mechanism, which may not always be convenient. Corresponding disadvantages are shared by other wet vacuum devices in the prior art.

SUMMARY OF THE INVENTION

The present invention addresses the problems cited above, and is an apparatus for drawing liquid from a floor or other surface using utilizing a flow of air provided by a suction source, and separating and collecting the liquid from the flow so as to avoid passing it through to the suction source.

Broadly, the apparatus comprises: (a) a liquid collection tank; (b) an intake opening in fluid communication with the collection tank, the intake opening being positionable proximate a floor or other surface; (c) means for establishing fluid communication between the collection tank and the suction source so that the flow of air is drawn in the intake opening and through the collection tank; and (d) a plurality of liquid separation passages into which the flow of air is divided between the intake opening and the collection tank, so that the liquid is separated from the flow of air and collected in the tank prior to the flow of air reaching the suction source.

The means for establishing fluid communication between the liquid collection tank and the suction source may comprise means for establishing fluid communication between the collection tank and a remote suction source. The means for establishing fluid communication between the collection tank and a remote suction source may comprises means for establishing fluid communication between the liquid collection tank and a hose leading to a household vacuum cleaner.

The plurality of liquid separation passages may comprise a plurality of elongate passages arranged in a bundle, the bundle having an intake end at which the flow of air and liquid enters the elongate passages and a discharge end at which the flow of air exits the passages with the liquid having been separated therefrom.

The apparatus may further comprise means for introducing the flow of air at an indirect angle to openings of the liquid separation passages at the intake end of the liquid separation bundle. The means for introducing the flow of air at an indirect angle to the intake openings of the liquid separation passages may comprise a plenum that is located at the intake end of the liquid separation body, and an inlet passage that directs the flow of air into the plenum at an indirect angle to the openings of the liquid separation passages. The plenum may comprise a substantially cylindrical wall extending annularly about the intake end of the bundle of liquid separation passages, the inlet passage directing the flow of air in a substantially tangential direction against the cylindrical wall so that the flow of air swirls within the plenum at the openings of the liquid separation passages.

The discharge end of the bundle of liquid separation passages may be located in an interior volume of the collection tank, so that liquid separated from the flow of air drops from the discharge end of the bundle into a lower portion of the tank, and air in the flow rises into an upper portion of the tank. The intake end of the bundle of liquid separation passages may form an upper end of the bundle and the discharge end of the bundle of liquid separation passages may form a lower end of the bundle, so that the flow of air enters the liquid separation passages from the plenum and flows in a substantially downward direction therethrough.

The apparatus may further comprise a nozzle member having the intake opening at a lower end thereof and the inlet passage into the plenum at an upper end thereof.

The means for establishing fluid communication between the collection tank and the suction source may comprise an actuating valve for selectively establishing fluid communication between the suction source and the upper portion of the collection tank. The apparatus may further comprise means for preventing liquid in the lower portion of the collection tank being drawn through the actuating valve with the flow of air as the tank fills with liquid. The means for preventing the liquid from being drawn through the actuating valve as the tank fills may comprise an outflow opening in the upper portion of the collection tank, through which the air flows to the actuating valve, and a float mounted in the collection tank so as to rise against and seal the outflow opening as the tank fills with liquid.

The apparatus may further comprise means for supplying a supplementary flow of cooling air to the vacuum source when the actuating valve is closed. The means for supplying a supplementary flow of cooling may comprise an inlet vent that is in fluid communication with the vacuum source on a downstream side of the actuating valve. The apparatus may further comprise means for closing the inlet vent so as to block the supplementary flow of cooling air when the actuating valve is opened, so as to apply substantially the entirety of the flow of air from the suction source to the collection tank. The means for closing the inlet vent so as to block the supplementary flow of cooling air may comprise a secondary valve for closing the inlet vent, and a linkage operably interconnecting the actuating valve and the secondary valve so that the secondary valve closes simultaneous with opening of the actuating valve. The linkage may comprise a shaft having the actuating valve mounted at a first location thereon and the secondary valve mounted at a second location thereon, and means for translating the shaft so as to move the actuating valve away from the valve opening to the collection tank and simultaneously move the secondary valve towards a valve opening leading to the inlet vent. The means for selectively translating the shaft may comprise an operating button mounted to the shaft that is selectively depressible under a finger of a user's hand.

In a preferred embodiment, the invention provides an apparatus for drawing liquid from a floor or other surface utilizing a flow of air provided by a suction source, the apparatus comprising: (a) a liquid collection tank having upper and lower portions and forward and rearward ends; (b) a lift nozzle mounted at the forward end of the liquid collection tank, the lift nozzle comprising a slot-shaped intake opening that extends transversely of the collection tank at a lower end of the lift nozzle, a generally upwardly-extending flow passage in fluid communication with the intake opening, and a generally rearwardly-extending flow passage in fluid communication with the upwardly-extending flow passage at an upper end of the lifting nozzle; (c) a plenum chamber mounted in the upper portion of the collection tank proximate the forward end thereof, the plenum chamber comprising a generally cylindrical wall defining upper and lower openings, a removable cap mounted over the upper opening, and an inlet opening in fluid communication with the rearwardly-extending flow passage of the lift nozzle, the inlet opening aligned in a generally tangential direction at the cylindrical wall of the plenum chamber; (d) a liquid separation body mounted under the lower opening of the plenum chamber, the liquid separation body comprising a generally downwardly concave upper end that forms a bottom to the plenum chamber, a lower end that is located in an interior volume of the collection tank proximate the lower portion thereof, and a plurality of elongate liquid separation passages having entry openings at the upper end of the liquid separation body and discharge openings at the lower end of the body; (e) a suction opening in the upper portion of the liquid collection tank; and (f) a valve assembly that selectively establishes fluid communication between a vacuum source and the suction opening in the upper portion of the collection tank.

The apparatus may further comprise means for preventing liquid in the collection tank from being drawn out through the suction opening as the tank becomes full. The means for preventing liquid from being drawn out through the suction opening in the upper portion of the collection tank as the tank becomes full may comprise a float valve mounted in the collection tank that rises against the suction opening in response to the tank becoming filled with liquid.

These and other features and advantages of the present invention will be more fully appreciated from a reading of the following detailed description with reference to the accompanying drawings.

DETAILED DESCRIPTION OF THE PREFERRED EMBODIMENTS

Figure 1:
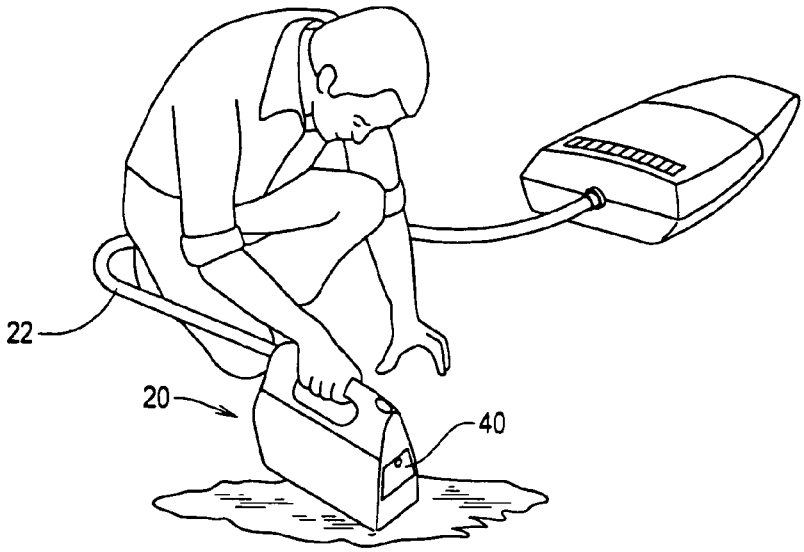
FIG. 1 is a perspective view of an exemplary embodiment of the present invention in use.

FIG. 1 illustrates an embodiment of the present invention that is used in conjunction with a conventional hose type vacuum cleaner. Although the suction generator is therefore located in a separate unit (i.e., the vacuum cleaner), it will be understood that some embodiments may be self-powered and include their own suction generator.

The suction assembly, generally indicated by the numeral 20, attaches to the vacuum cleaner hose 22, and when the nose or snout thereof is pushed downward into the puddle of liquid, wet carpet, etc., will vacuum up the liquid automatically without operation of any trigger mechanism or other control.

Figure 2:
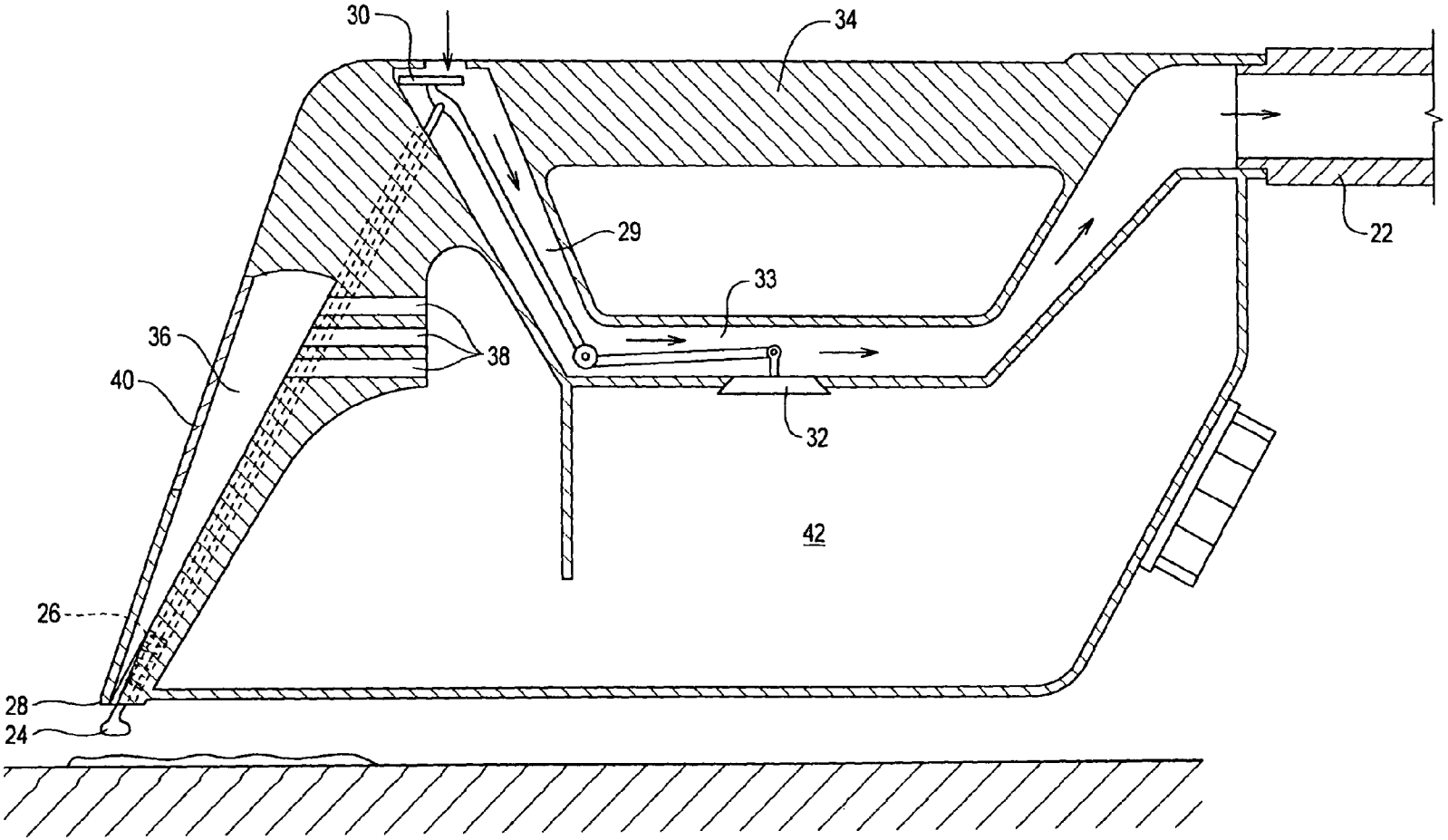
FIG. 2 is a side cross section of the embodiment of FIG. 1 illustrating the valves therein in a rest state, providing cooling air to the vacuum motor.
Figure 3:
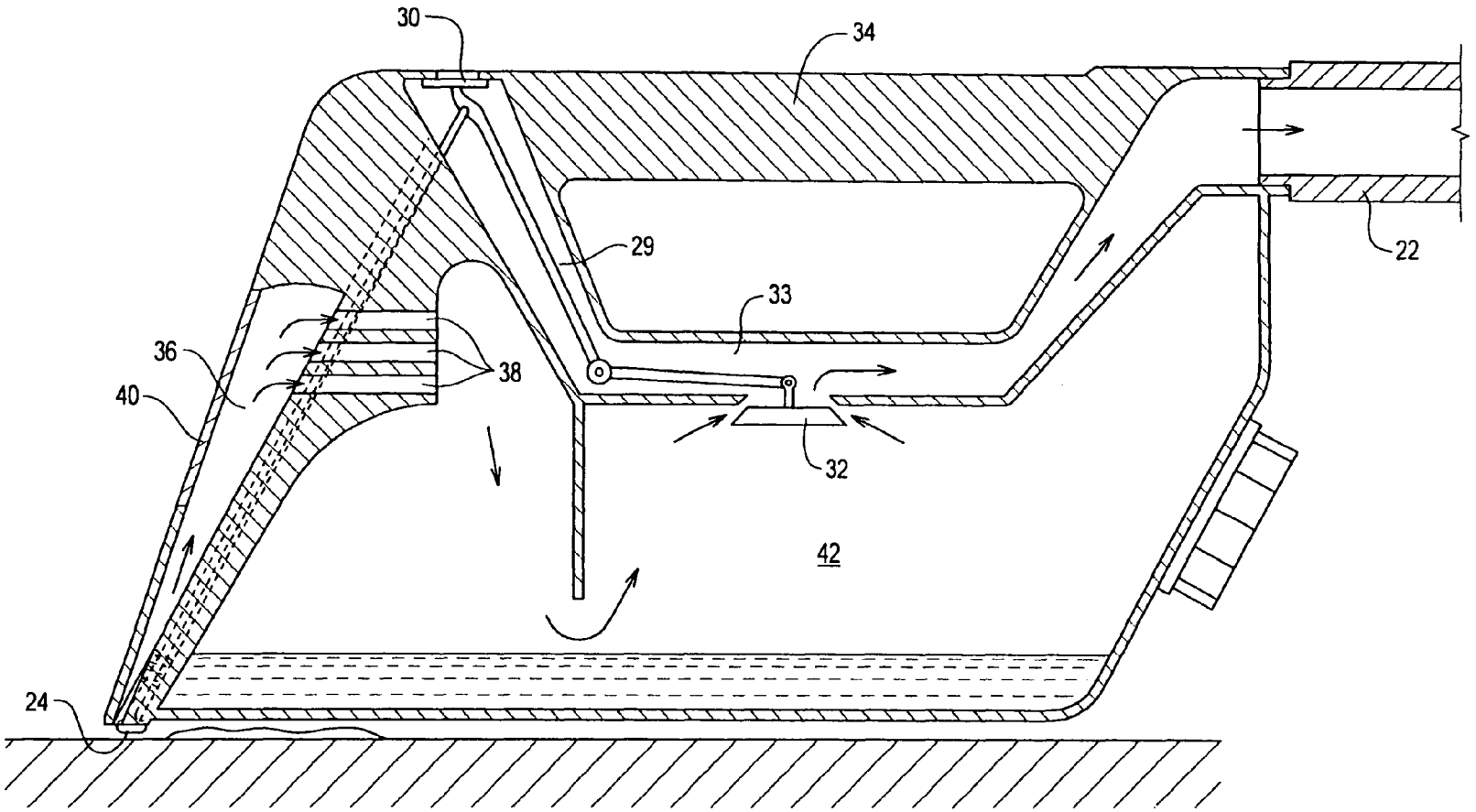
FIG. 3 is a side cross section of the embodiment of FIG. 1 illustrating the valves therein in a vacuuming state, providing suction to the attachment to vacuum up liquids and to vacuum moist surfaces.

FIGS. 2 and 3 show cross sections of the attachment 20 of FIG. 1 in a non-operative mode and in an operative mode, respectively. When held in a position such as shown in FIG. 2, a rod or feeler 24 is urged to the downward position by a spring 26 (see also FIG. 4) so that the feeler 24 extends below the snout 28 of the attachment. The upper end of the rod 24 is attached to a linkage 29 that interconnects first and second valves 30, 32 so that they are alternately opened, i.e., when valve 30 is open valve 32 is closed, and vice versa. As can be seen in FIG. 2, the first valve opens to establish fluid communication between the exterior of the attachment and the main suction passage 33 that leads to the vacuum cleaner. The valve 32, in turn, opens to establish communication between the main suction passage and the interior collection tank of the assembly so that the liquid will be drawn therein, as will be described in greater detail below. Leakage upward along the shaft 24 may be prevented by an appropriate seal, such as an appropriately positioned O-ring, for example.

Accordingly, when the assembly is raised above the floor as shown in FIG. 2, the spring 26 extends rod 24 to the lowermost position, at the same time drawing valve 30 downwardly to its open position and raising valve 32 to its closed position. Thus the vacuum draws air through valve 30, through the passage 33 below the handle 34, and ultimately through the vacuum cleaner hose 22 to the vacuum cleaner, thereby venting the attachment to provide adequate motor cooling airflow through the vacuum cleaner and to avoid overloading the motor. The spring 26 preferably provides a spring force that is adequate to elevate the front of the attachment above a surface it is resting on unless intentionally pushed down to vacuum up a liquid (or vacuum a moisture soaked surface). This assures that adequate airflow is obtained for vacuum motor cooling if the vacuum cleaner motor is left on with the attachment resting on any surface, such as a tile, stone or hardwood floor.

However, when the snout 28 is pushed down against a surface in order to vacuum up a liquid, rod 24 will be pushed upward against the force of spring 26 as shown in FIG. 3, thereby closing valve 30 and opening valve 32. This changes the flow through the attachment, so that it no longer enters through the vent inlet valve 30, but instead enters the snout and flows through the liquid separation and storage tank 42, through valve 32 and out through vacuum hose 22. The liquid is thus lifted from the floor or other surface and collected in the storage tank 42, simply by pressing the snout down against the area of the spill, without the operator having to actuate a separate switch or trigger.

Figure 4:
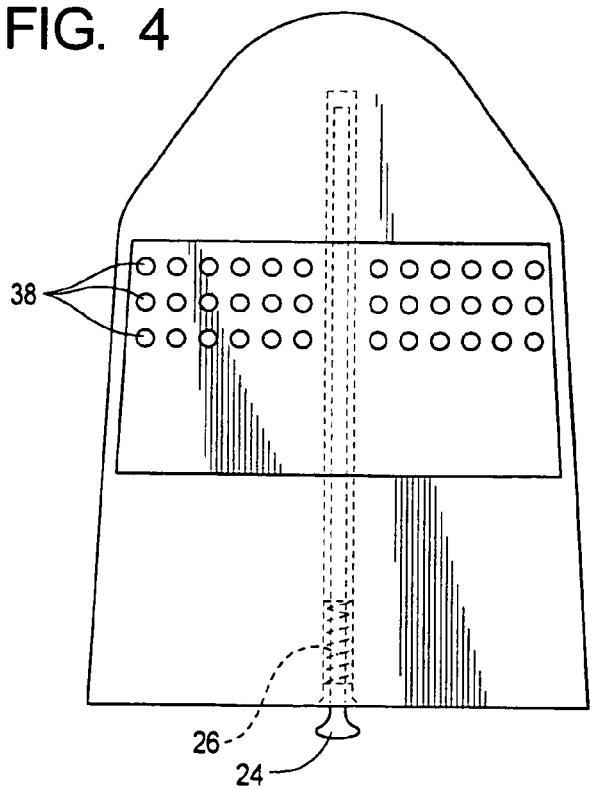
FIG. 4 is a front view of the attachment of FIGS. 1-3 with the access plate 40 removed.

Another important aspect of the present invention may also be seen in FIGS. 2-3, and in FIG. 4, the latter being a front view of the attachment with the access plate 40 removed. In particular, it will be noted that instead of a single large opening from the snout chamber 36 to the liquid separation and storage chamber 42, a plurality of much smaller openings 38 are provided for this purpose. In a preferred embodiment, a matrix of relatively small openings are provided as shown in FIG. 4, the purpose of which may be explained as follows: It has been discovered that a typical home vacuum cleaner can potentially induce such a large air flow through a liquid separation and storage chamber that liquid droplets are not given adequate time to settle out under the force of gravity before being swept along and ingested through the vacuum cleaner hose 22 to the vacuum cleaner. It has also been discovered that while this large airflow or suction may be advantageous in vacuuming up liquids, it is not a necessity, as adequate vacuuming of liquids can be achieved with substantially reduced airflow. Thus in the present invention, the flow is specifically restricted. In the embodiment shown, the flow between the snout 28 and the liquid separation and storage chamber 42 is restricted and divided up by a plurality of relatively small tubular passages between these two volumes. While a plurality of small orifices could be used, tubular flow restrictors are preferred, as tubular flow restrictors create less turbulence than orifices, and the less that a liquid being vacuumed up is atomized, the faster it will settle out in the liquid separation and storage chamber 42.

As an upper limit on the extent of flow restriction useable, the flow must be adequate to cause a liquid to be sucked up through the snout and through the tubular passages 38. For this purpose, the flow cross section up the snout should not be made too large, as otherwise liquids vacuumed up may simply separate from the air flow and stay in the snout, then pouring out again when the vacuum is turned off.

FIG. 4 shows a liquid extracting assembly 50 in accordance with a second embodiment of the present invention. As will be described below, operation is similar overall to the embodiment described above. However, the linkage is replaced by a manual push button for actuating the main lifting flow.

As can be seen in FIG. 4, the assembly 50 includes a snout portion 52 having a depending rod or plunger 54 similar to that described above, that is urged to a downwardly extended position by a coil spring 56. The shaft of the plunger extends upwardly through a passage in the forward body 58 of the assembly, with a vent valve 60 being mounted at its upper end. The valve controls flow through vent opening 62, which establishes communication between an exterior air inlet chamber 64 and the main suction passage 66 that leads to the vacuum hose; the valve 60 may be provided with an elastomeric cap (not shown) and/or the seat may be provided with an elastomeric ring, in order to ensure an air tight seal. The inlet air chamber 64 is covered by a shield 68 that excludes debris from the chamber and prevents damage to the valve and its seat, with air entering the chamber through slots 70.

Accordingly, when the attachment is held with its snout portion out of contact with the working surface, the spring 56 urges the plunger 54 downwardly in a manner similar to that described above, thus lowering valve 60 away from its seat at vent opening 62, from intake chamber 64 into the main suction passage 66 and thence to the vacuum hose, providing cooling air and preventing overloading of the motor as described above. A resilient bushing 72 is mounted around the stem of the valve 60, where the stem passes through the floor 76 of the main suction passage 66, in order to maintain the integrity of the passage and eliminate air leaks about the valve stem and plunger.

Figure 5:
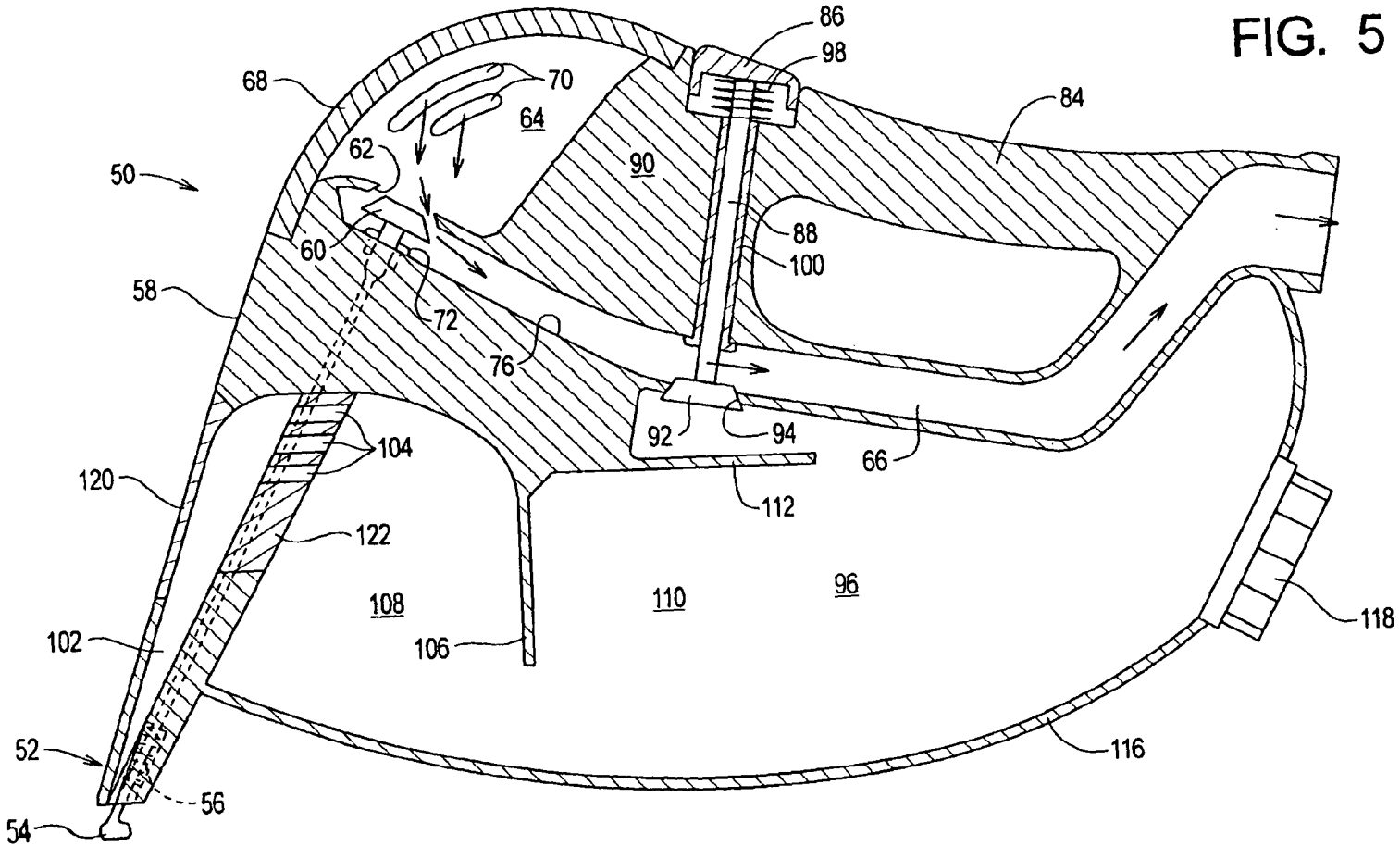
FIG. 5 is a side cross section of a second exemplary embodiment of the present invention, illustrating the valves therein at the rest state, providing cooling air to the vacuum motor.
Figure 6:
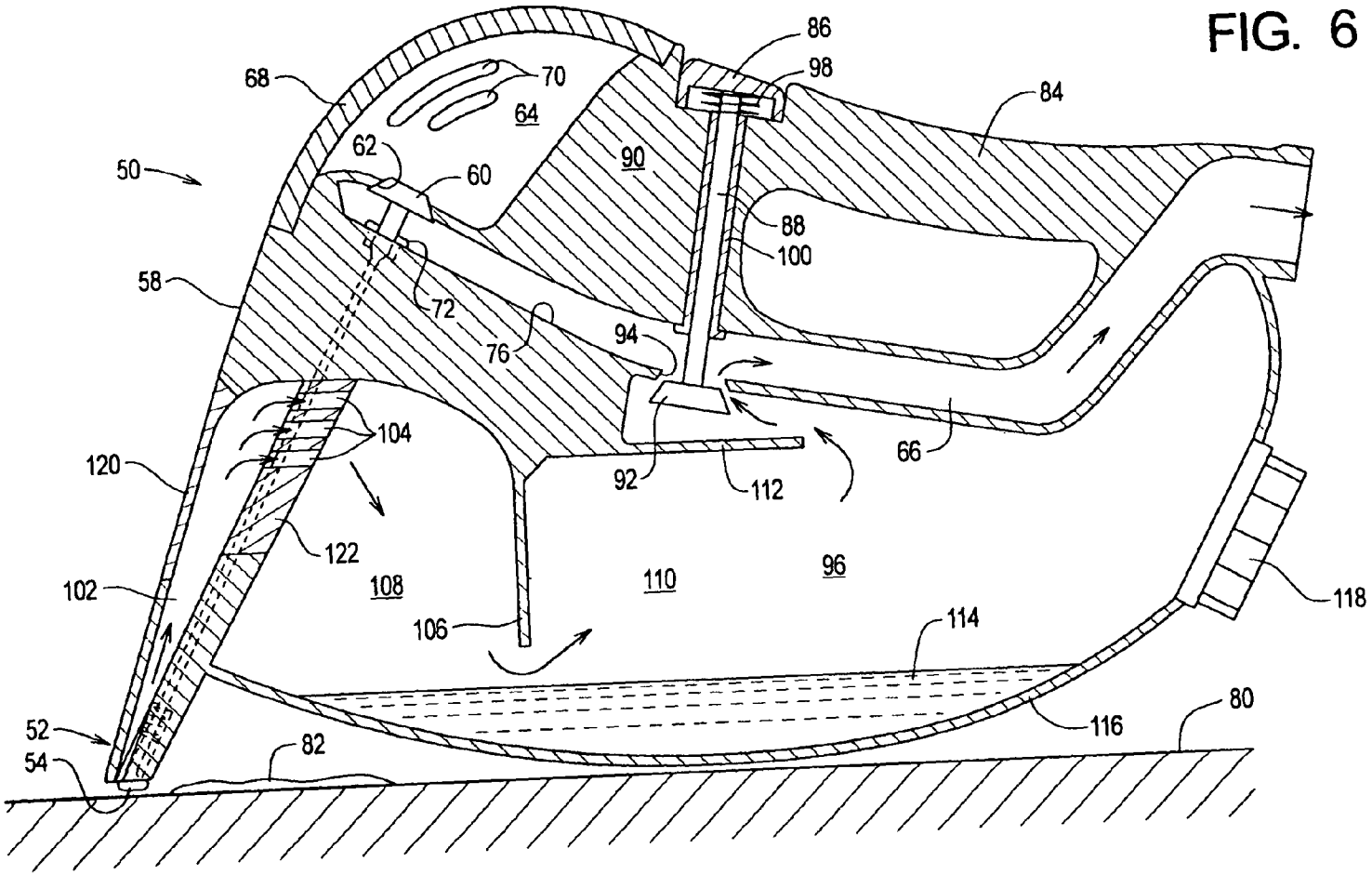
FIG. 6 is a side cross section of the embodiment of FIG. 5, illustrating the valves therein in a vacuuming state, providing suction to the attachment to vacuum up liquids and to vacuum moist surfaces.

When, in turn, the snout portion of the attachment is pressed against a surface 80 to lift the liquid 82 therefrom, as shown in FIG. 5, the upward pressure on the plunger presses the valve 60 against its seat, thus closing vent opening 62. The operator, grasping the attachment by its handle 84, moves of the snout to the location of the liquid 82, and then depresses actuating button 86. This presses downwardly against a second rod 88 that extends downwardly through an upper portion 90 of the body, so as to depress the main suction valve 92 away from its seat at opening 94 and thereby establish communication between the main suction passage 66 and the liquid collection tank 96. When the button is released, a coil spring 98 under the button raises the shaft 88 and returns valve 92 to its closed position to seal off the passage 66; a sleeve 100 is mounted around shaft 88 to prevent air leaks, and the valve/seat may also be provided with seal members as described above.

When valve 92 is in the open position, suction flow is established from the snout intake to the vacuum hose via the collection tank, as described above. The liquid and air are therefore drawn into the snout chamber 102 and pass through the plurality of tubular passages 104, before being directed downwardly towards the bottom of the tank by a first, generally vertical baffle 106. As can be seen in FIG. 5, the baffle 106 defines a forward chamber 108 within the collection tank, where the majority of liquid will fall out of the airflow. The air then passes under the baffle into a larger, rearward chamber 110, in which direct flow to the suction opening 94 is blocked by second, generally horizontal baffle 112. The remainder of the liquid 114 therefore has sufficient time to drop out and collect in the bottom of the tank, prior to the airflow passing into the main suction passage 66.

As can be seen in FIG. 5, the collection tank 96 is preferably formed with a curved bottom wall 116, which facilitates rapid and convenient emptying of the tank when the cap 118 is removed.

The snout portion of the attachment is provided with an access door 120 that can be removed for cleaning the intake sides of the flow tubes 104; a suitably sized, detachable rod (not shown) may be provided for this purpose. Moreover, in the embodiment that is illustrated in FIGS. 4-5, the flow tubes 104 are formed in a detachable restrictor plate 122 that can be accessed and removed via the door 120. This permits the use of interchangeable restrictive plates having different sizes and/or numbers of flow tubes, thereby allowing the flow and fluid collection characteristics to be tailored to a particular liquid or situation; for example, a first restrictive plate having a relatively large number of small-diameter tubular passages may be used for comparatively thin or "light" liquids having a tendency to atomize, while a different restrictor plate having larger and/or fewer passages may be used for relatively viscous, heavy liquids, or for situations when particulate matter may be combined with the liquid.

FIGS. 7-17 show another preferred embodiment of the present invention, that utilizes a push-button actuated suction mechanism rather than the bottom-projecting feeler rod of the preceding embodiment, and differs in other respects as well, but that again utilizes a multiple passage liquid-separation structure.

Figure 7:
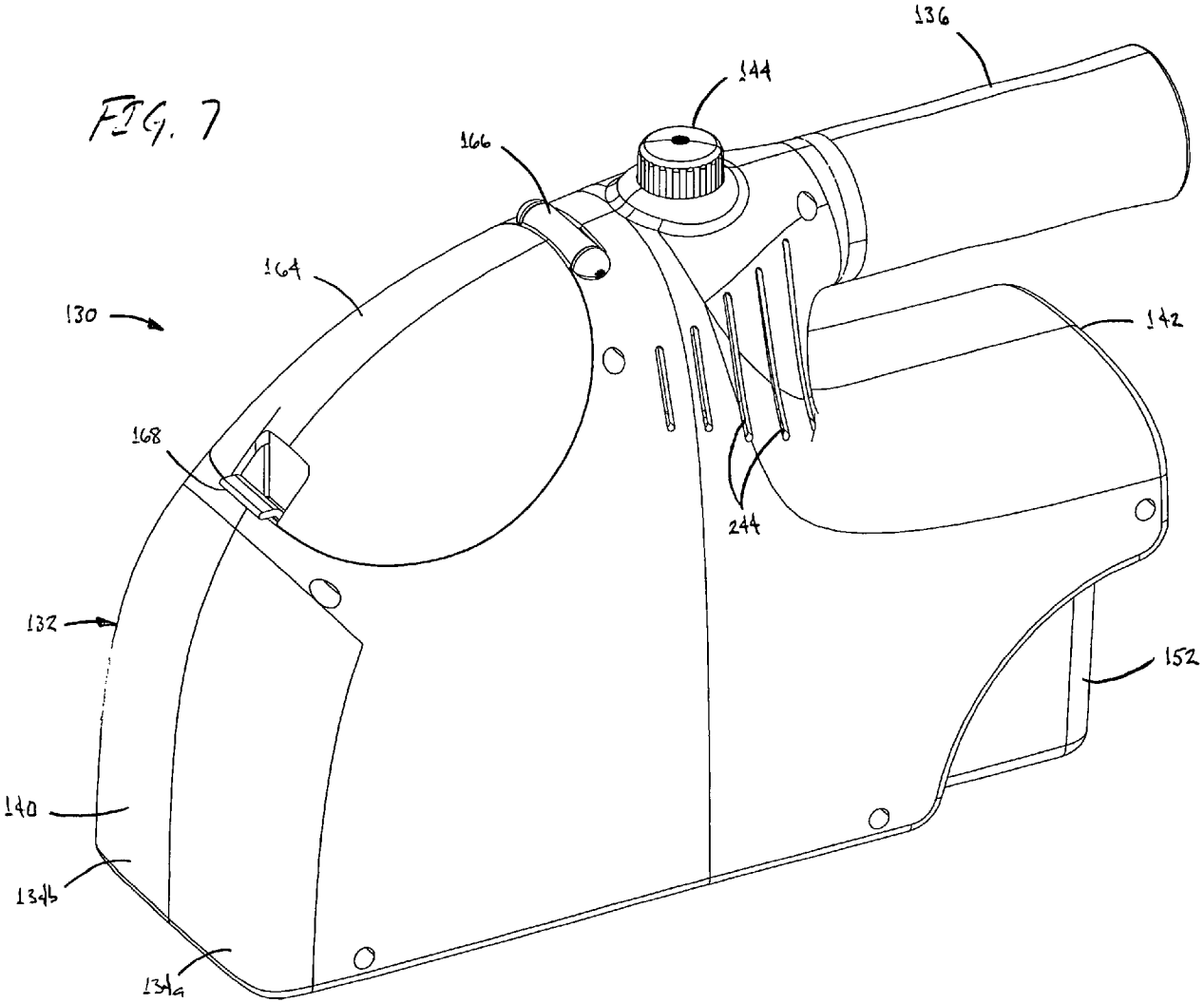
FIG. 7 is a front perspective view of a liquid separation nozzle assembly in accordance with another embodiment of the present invention, which utilizes a manual actuating button rather than a feeler rod and differs in a number of other respects from the embodiment of FIGS. 1-6.
Figure 8:
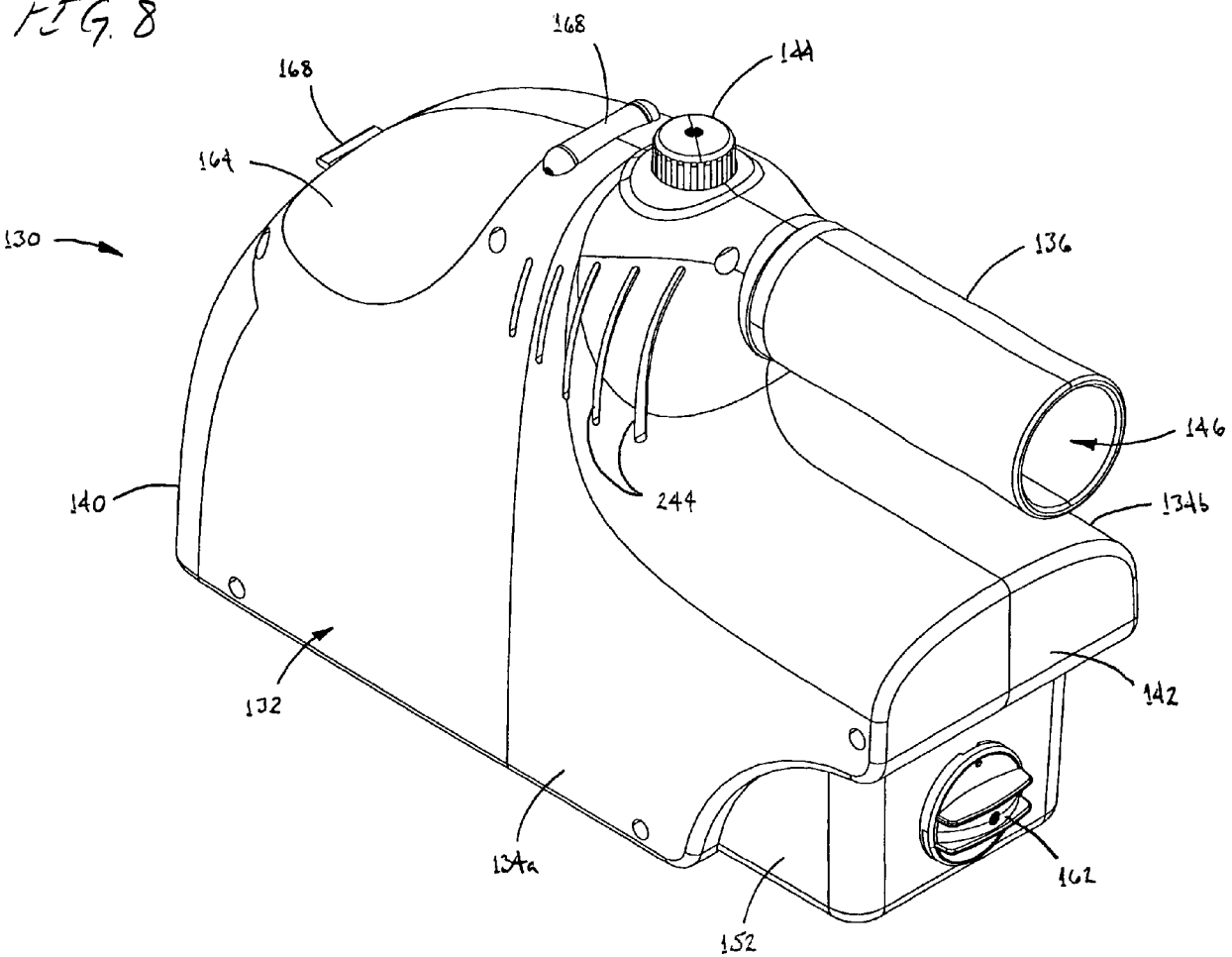
FIG. 8 is a rear elevational view of the liquid separation nozzle assembly of FIG. 7, showing the suction duct or pipe that forms a handle of the nozzle and other aspects of the assembly in greater detail.
Figure 9:
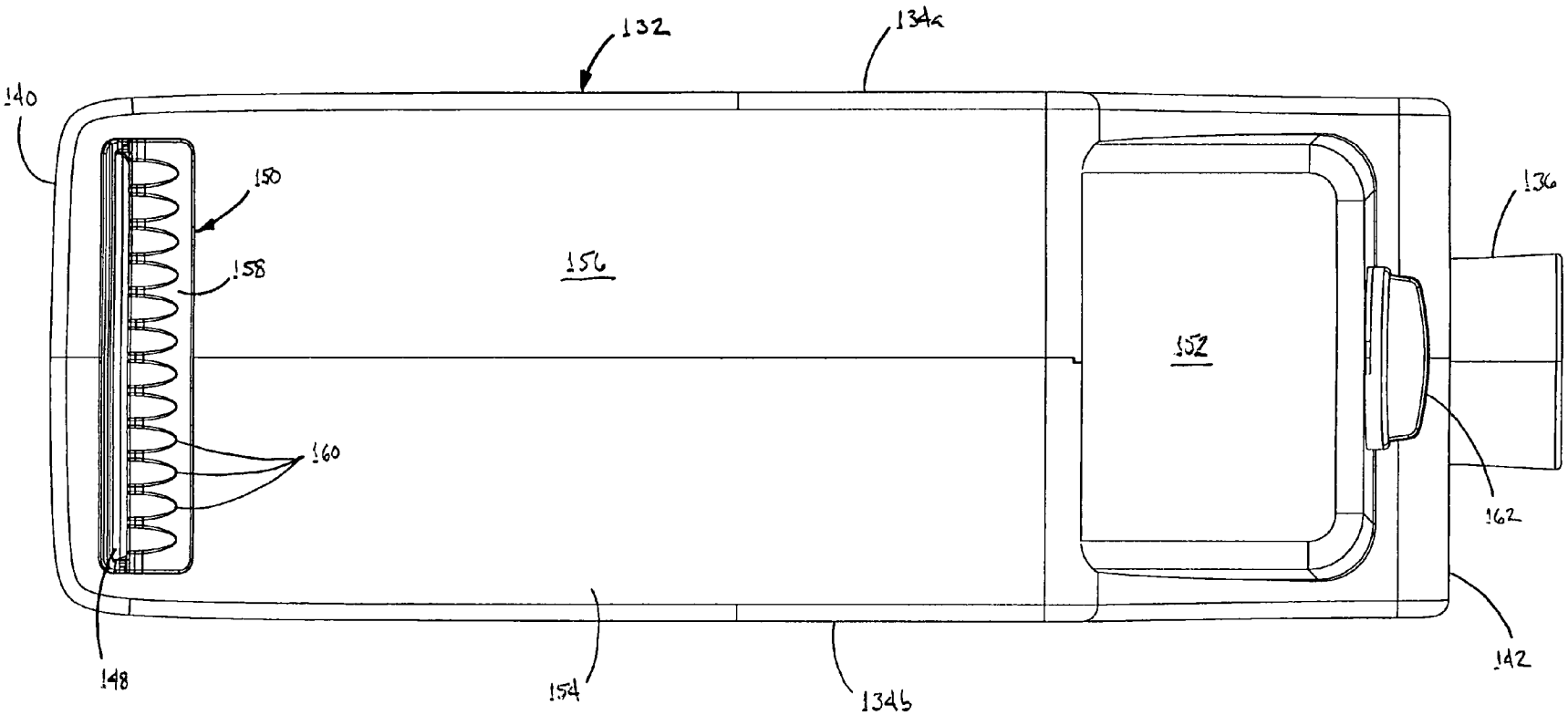
FIG. 9 is a bottom plan view of the liquid separation nozzle assembly of FIGS. 7-8, showing the arrangement of the suction intake at the forward end of the sole plate of the assembly.
Figure 10:
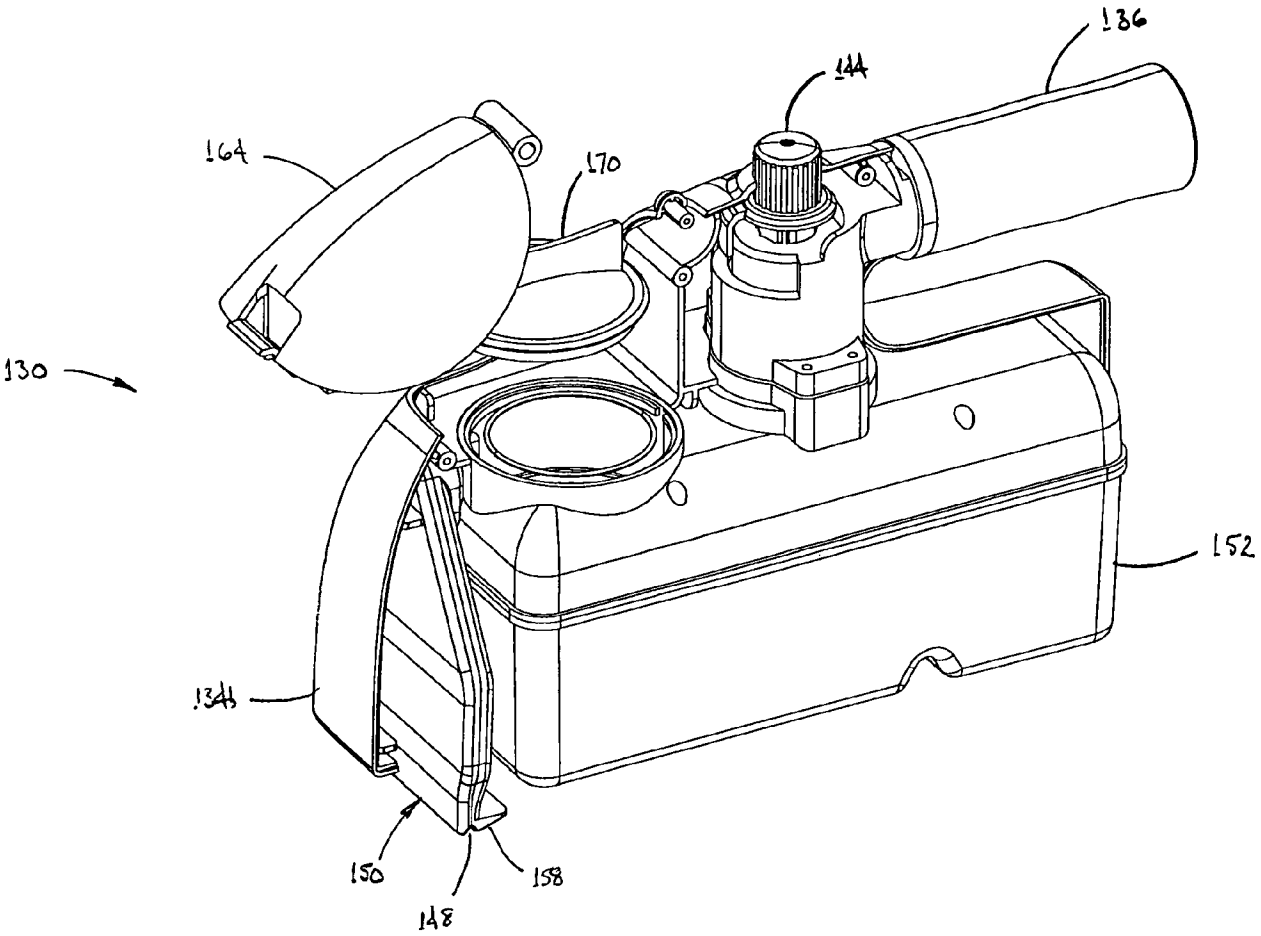
FIG. 10 is a perspective, cutaway, partially exploded view of the liquid separation nozzle assembly of FIGS. 7-9, showing the collection tank and other internal aspects of the assembly in greater detail.

As can be seen in FIGS. 7-9, the nozzle assembly 130 includes a body 132 with an outer housing formed in first and second bilateral halves 134*a*, 134*b*. A generally horizontally extending pipe portion 136 mounts to a suction source (not shown), such as a portable vacuum cleaner as described above. The pipe portion 136 also serves as a handle, and is sized to conveniently gripped by a user; the orientation of the pipe portion 136, in conjunction with the natural direction of motion of a user's hand, therefore defines forward and rearward ends 140, 142 of the assembly.

A thumb-depressible button 144 is positioned proximate the forward end of the suction pipe 136, where the latter joins the rest of the body 132, and controls the flow of air through the interior passage 146 of the pipe portion to the remote suction source. As will be described in greater detail below, depressing control button 144 actuates a plunger to apply suction to the downwardly-directed opening 148 of the pickup nozzle 150 (see FIG. 9) of the assembly, via a liquid separation body and collection tank 152.

As can be seen in FIG. 9, the bottom surface 154 of the body 132 is substantially planar, forming a flat sole plate 156. The bottom surface 158 of the pickup nozzle 150 lies substantially flush with the sole plate 156, with the slot-shaped intake opening 148 extending across substantially the full width of the sole plate proximate the forward end 140 of the housing. The flat sole plate and nozzle surface 158 therefore permit an operator to slide the assembly over a carpet or similar surface while gripping the handle formed by the pipe portion 136 and applying a slight downward pressure, in a manner similar to the use of a clothes iron. A plurality of semi-elliptical grooves 160 trail longitudinally from the main intake slot 148, in the bottom surface 158 of the pickup nozzle, so as to increase the size of the suction contact patch and help channel and pick up additional fluid as it is squeezed from the carpet or other material by the downwardly pressure and forward motion of the assembly; as can be seen in FIG. 11, the bottom surface 158 of the pickup nozzle, rather than being exactly coplanar with the lower surface 154 of the sole plate 156, is angled slightly downwardly therefrom in a forward direction, so that the intake slot 148 will press slightly into the carpet or other material as the assembly is slid thereover.

As can be seen in FIGS. 8-9, the collection tank 152 includes a drain plug 162 which allows accumulated liquid to be dumped from the rearward end of the assembly. A hatch 164 atop the forward end of the assembly, that pivots upwardly about hinge 166 when a finger-operated latch 168 is released, provides access to a cap 170 (see FIG. 10) near the front of the tank that when opened allows accumulated fibers and other material to be removed from over the liquid separation cartridge or body. Both of these features will be described in greater detail below.

Figure 11:
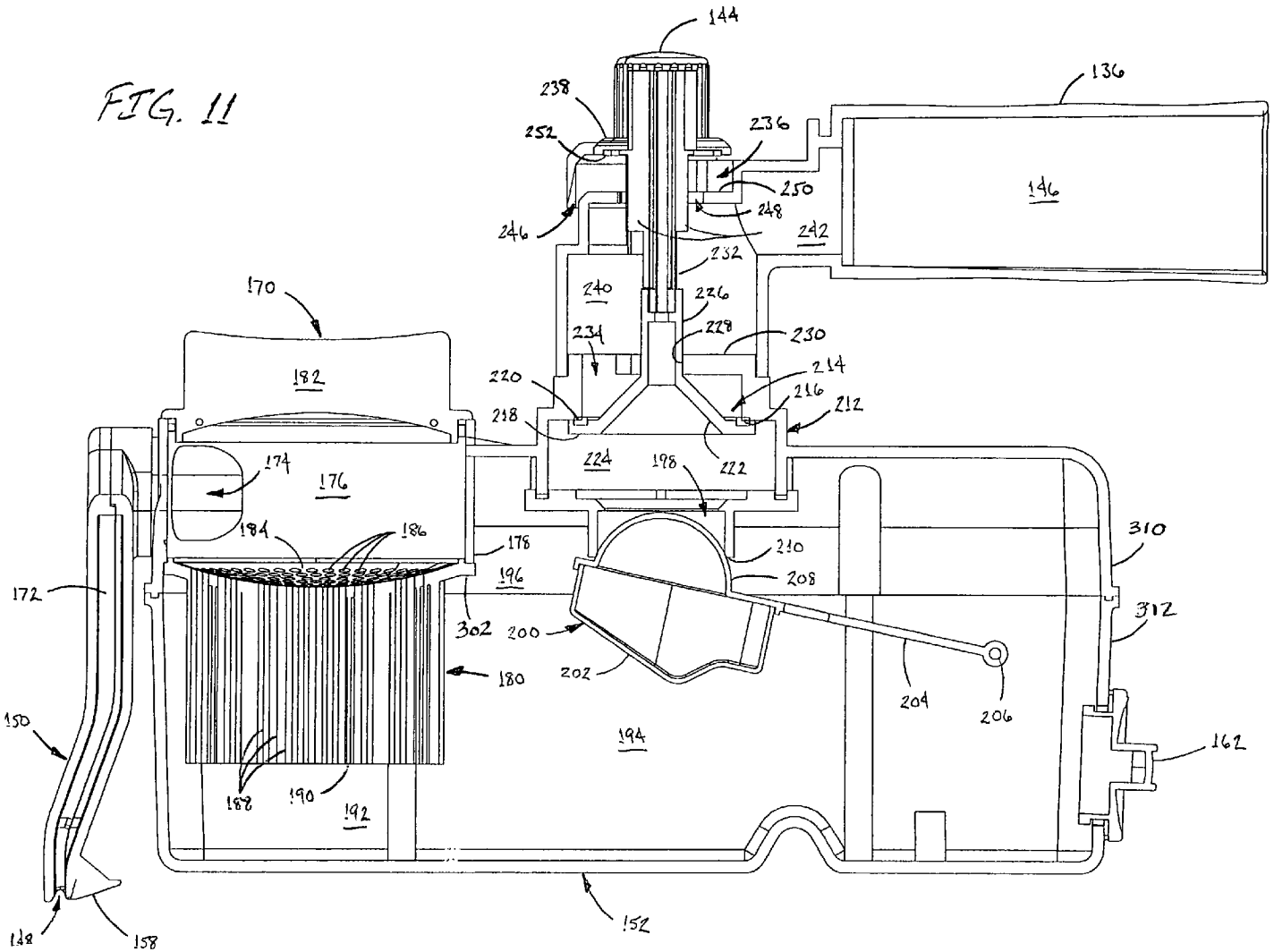
FIG. 11 is a cross-sectional view of the liquid separation nozzle assembly of FIGS. 7-10, taken longitudinally through the assembly and with the external shell pieces removed for ease of viewing, showing the mechanisms associated with the collection tank and the control valve and suction passage portions of the assembly.

FIG. 11 is a cross-sectional view showing the internal structure and mechanisms of the nozzle assembly 130, with the external shell eliminated for ease of viewing.

As viewed in FIG. 11, the flow path of water/liquid through the assembly progresses generally from left to right, starting with the pickup nozzle 150 and exiting through the tubular handle 136 to the external vacuum source. The liquid and air are drawn upwardly through the slot-shaped intake opening 148 of the uptake nozzle 150 and into a vertically-extending passage 172 within the nozzle. The flow is then redirected from the vertical passage 172 inside the nozzle into a generally horizontally-directed passage 174 that leads into a generally cylindrical entrance chamber 176 in the upper, forward part of the body of the collection tank 152. The entrance chamber is formed by a cylindrical wall 178, with the lower end of the chamber being positioned above, and sealed by, the liquid separation cartridge 180; the upper end of the entrance chamber in turn being sealed by access cap 170, the latter having a vertical flange-shaped portion 182 to aid in manual removal, as will be described below.

As can be seen in FIG. 11, the upper surface 184 of the liquid separation cartridge 180 is generally concavely (downwardly) dished, and includes openings 186 into a plurality of generally vertical, small-diameter bores 188 formed within the body of the cartridge 180.

As will be described in greater detail below, the multiple elongate bores 188 serve to separate the liquid (e.g., water) from the air, after which the two fluids exit more-or-less discrete at the bottom end 190 of the body and enter the underlying capture area 192 at the front tank 152. The liquid flows into and is retained within the main volume of the tank 194 of the tank 152, while the air is drawn to the upper portion 196 of the tank and out through a first valve opening 198. A float assembly 200 cooperates with the first valve opening to prevent water or other liquid from being drawn out through the opening (and thereby possibly damaging the suction source) in the event that the tank become full: As can be seen, the assembly 200 includes a float body 202 that is mounted on an arm 204 which is in turn connected to a horizontal axis pivot 206. As the tank becomes full of liquid (for example, water), the float body 202 rises so as to press its hemispherical upper shell or face 208 against the rim 210 of the valve opening, with the force of the suction section drawing the float firmly against the opening so as to form a liquid-tight seal; then, when suction is secured and the tank is emptied, the float assembly 200 drops away from the valve opening 198 so that air can be drawn therethrough for normal operation of the apparatus.

As can be seen with further reference to FIG. 11, opening 198 forms the lower opening in a valve body 212 that is situated atop the collection tank 152. The upper opening 214 in the body has a lip 216 that forms a seat for the main actuating valve 218 of the assembly, with a resiliently compressible ring 220 about the edge of the valve forming an airtight seal with the edge of the opening when the parts are in contact. The lower side of the actuating valve 218 includes an upwardly-projecting frustoconical surface 222 against which the air pressure within the chamber 224 of the valve body, between the lower and upper openings, acts to force the valve towards the closed/sealed position. The upper portion of the valve includes a cylindrical stem 226 that passes through a close-fitting bore 228 in the generally horizontal upper wall of the valve body, so that the bore acts as a guide for vertical reciprocating movement of the valve stem, the guide being supported on horizontal struts 230 (see FIGS. 12-13). The stem 226 is in turn mounted coaxially to a vertically-extending shaft 232 that is formed integrally with the actuating button 144. Thus, by pressing downwardly on the button 144, in the manner of a plunger, the operator depresses the valve 218 away from its seat (lip 216), thereby opening communication between chamber 224 and the upper passages 234 of the valve body; in so doing, the chamber 224 provides clearance for downward movement of the valve away from its seat, and a gap 236 likewise provides clearance for downward movement of an annular flange 238 around the base of the actuating button 144.

Thus, when the actuating button is pressed, the valve 218 is depressed off of its seat so that air is able to be drawn through both the lower and upper openings 198, 214 (as was discussed above, the float assembly will normally be lowered away from the lower opening 198 unless the collection tank is full), and from the upper chamber 214 through passage 234 to an upper chamber 240 that surrounds the valve stem and the shaft of the actuating button; from the upper chamber, the air is drawn through a right-angled neck 242 leading to the internal passage 146 of the handle 136, and from there to the remote vacuum source.

When the actuating button 144 is released, the airflow from chamber 224 through opening 214 drives the valve 218 back up against its seat, at the same time raising the button 144 back to its original position; if desired, a return spring may be included to assist the closing action. When the valve returns to its seat, airflow through the valve body is blocked, terminating the flow through the tank and separator body and therefore the suction action at lifting nozzle 150. To provide cooling for the motor of the suction source, however, a secondary flow is drawn in through vent openings 244 (see FIGS. 7-9) and under the actuating button 144 via gaps 246, 236; the air then flows downwardly around the shaft 232 through opening 248, entering chamber 240 and then flowing via the neck 242 and passage 146 to the vacuum source. A plurality of radially-extending, strut-like ridges 237 on the valve-actuating shaft 232 act against the edges of opening 248 so as to center and support the shaft for vertical reciprocating movement while maintaining openings around the shaft for flow of air therethrough.

Thus, when the actuating button 144 is released and in its raised position, as shown in FIG. 11, a flow of cool air continues to be supplied to the even though flow through the tank and main pickup nozzle of the assembly is blocked. Then, when the button 144 is depressed, the flow through the tank and pickup nozzle is established in the manner described above; simultaneously, the annular base flange presses down flat against the horizontal wall 250 around opening 248 so as to stop the secondary flow through gaps 246, 236 and thereby ensure that the suction is directed fully to the pickup nozzle, with an airtight seal between the pieces being established by an annular, resilient sealing ring 252 on the bottom of flange 238.

Figure 12A:
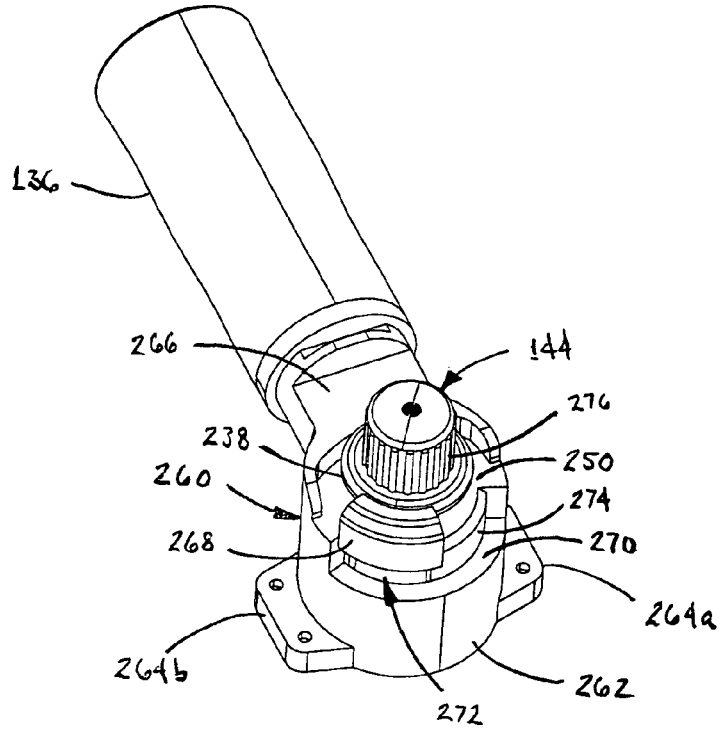
FIG. 12A is a front perspective view of the upper section of the valve body of the liquid separation nozzle assembly of FIGS. 7-9, showing the manner in which the strength of suction is adjustable by rotating the actuating button of the assembly.
Figure 12B:
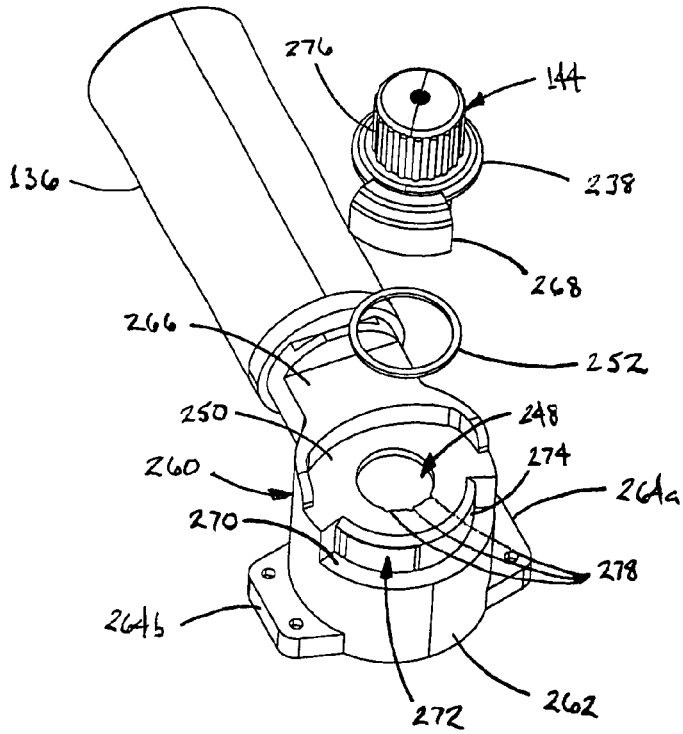
FIG. 12B is a perspective, exploded view of the upper valve body section of FIG. 12A, showing the relationship of the components thereof in greater detail.

As an additional feature, the actuating button 144 serves to control the amount of flow or "strength" of the suction that is supplied at the lifting nozzle 150. As can be seen in FIGS. 12A-12B, which show a front aspect of the detachable upper portion 260 of the valve body 212 (see FIG. 11). As can be seen, the upper section of the body includes a tubular, generally cylindrical shell 262 having an open lower end that attaches over the opening 234 leading to the tank, by means of base flanges **262*a*, 264*b* and associated screws (not shown). The upper end of the tubular shell 262 is covered by a flat, annular wall 250 that has opening 248 formed therein, which accommodates valve shaft 232** as described above.

As was described with reference to FIG. 11, air (entering via vent slots 244) is drawn through the gap between wall 250 and the annular flange 238 of actuating button 144 when the button is in the raised, released position and the main valve 218 is therefore closed, in order to provide a cooling flow that passes through a connecting, 90-degree neck portion 266 into tubular handle 136. Then, when the actuating button 144 is depressed flange 238 comes into contact with annular wall 250, and with the aid of sealing ring 252 seals off the gap so that the suction flow is applied to the main opening into the tank.

The strength of that flow is, however, selectively adjustable by rotating the actuating button 144: As can be seen with further reference to FIGS. 12A-12B, an outwardly and downwardly projecting flap portion 268 depends from the flange 238 of the actuating button, and is received in a cooperating, somewhat semi-circular channel 270 that is formed in the front, upper edge of tubular shell 262; in the illustrated embodiment, the channel 270 extends through an arc of about 150°, although this may vary depending on design factors.

One end of the channel 270 is proceeding through opening 272 leading from outside the valve body to the interior of the tubular shell 262, while the opposite end of the channel is closed by a corresponding curved, vertical wall section 274.

The depending flap portion 268 of the actuating button has a curvature matching that of the channel 270 and is received in the channel as shown in FIG. 11, but has a width such that it extends through only a portion of the full arc of the channel. In the illustrated embodiment, the arc of the flap is preferably equal to about one-half the total arc of channel 270 (e.g., approximately 75°, and slightly greater than the arc of the opening 272 (e.g., approximately 60°) that is formed at one end of the channel.

Therefore, when the shaft of actuating button 144 is rotatingly received in opening 248, the depending flap 268 rides within channel 270 so as to act as a shutter that selectively adjusts the effective size of opening 272. To maximize the strength of the suction at the pickup nozzle, the button is rotated clockwise (in the embodiment that is illustrated) so that flap 268 substantially covers opening 272, as shown in FIG. 12A, ensuring that the majority of flow is applied to the nozzle; to reduce the intensity of the suction, the actuating button is rotated in a counter-clockwise direction to move flap 268 away from over opening 272, progressively increasing the amount of bypass flow (drawn through vent slots 244 as described above) that enters through opening 272 instead of being applied to the pickup nozzle.

In the illustrated embodiment, suction at the pickup nozzle is therefore maximized with the actuating button rotated to a full clockwise position, and minimized with the button rotated to a full counter-clockwise position, with intermediate positions providing gradations in suction intensity. Ridges 276 around the exterior of the actuating button 144 provide a finger grip to aid in rotating the button. In addition, a plurality of shallow notches 278 on the perimeter of opening 248 cooperatingly engage the edge of one of the strut-like ridges 237 on the button shaft (see FIG. 11) so as to act as detents that prevent an accidental 13-15 show in greater detail the relationship between the entry chamber or plenum at the top of the collection tank and the passage by which flow enters the chamber from the pickup nozzle, and the manner in which these features cooperate with the liquid separation body that leads into the main volume of the tank.

Figure 13:
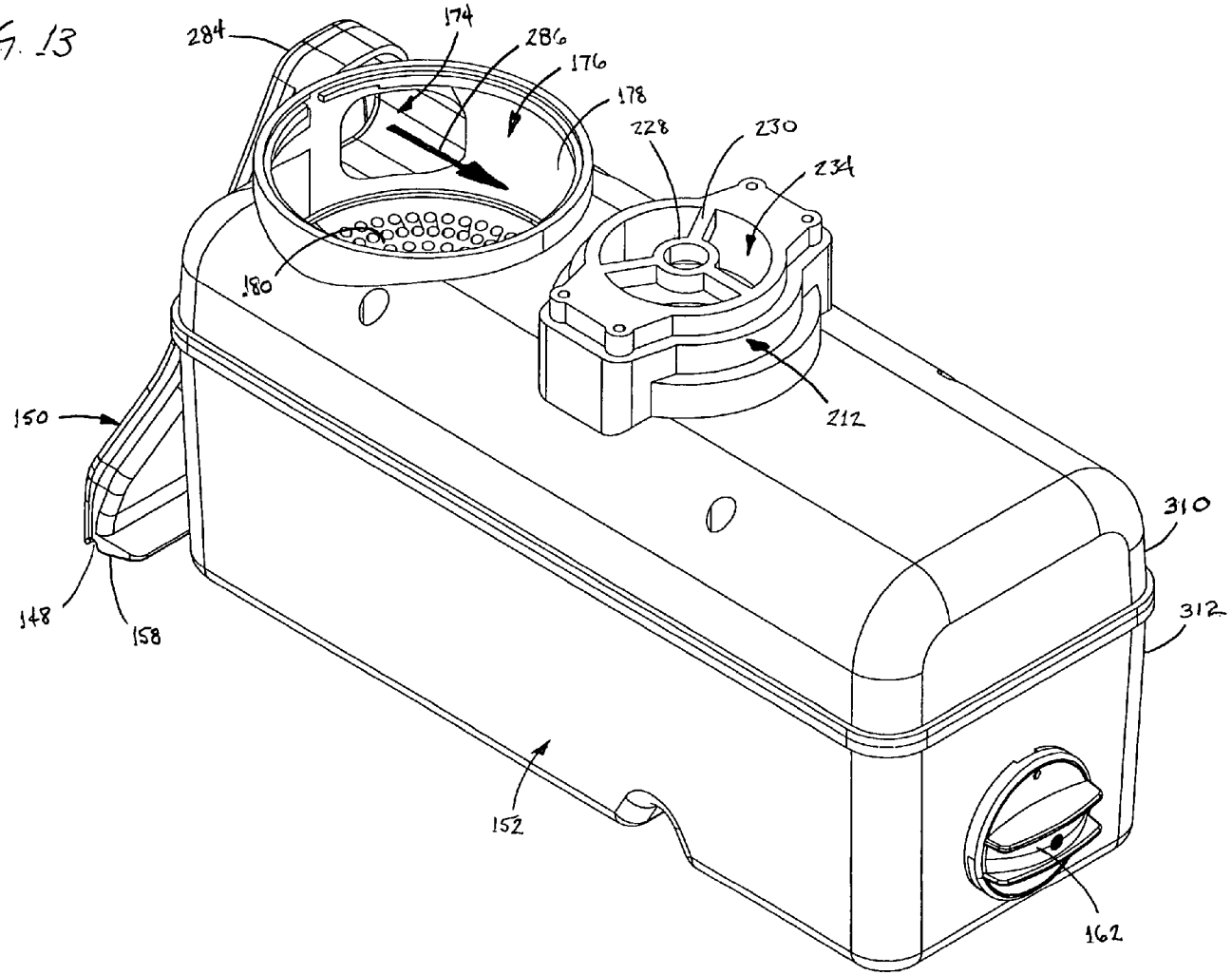
FIG. 13 is a rear perspective view of the collection tank and pickup nozzle of the liquid separation nozzle assembly of FIGS. 7-9, showing the offset, tangential relationship between the passage leading from the upper end of the pickup nozzle and the cylindrical plenum or entrance chamber above the liquid separation cartridge.
Figure 14:
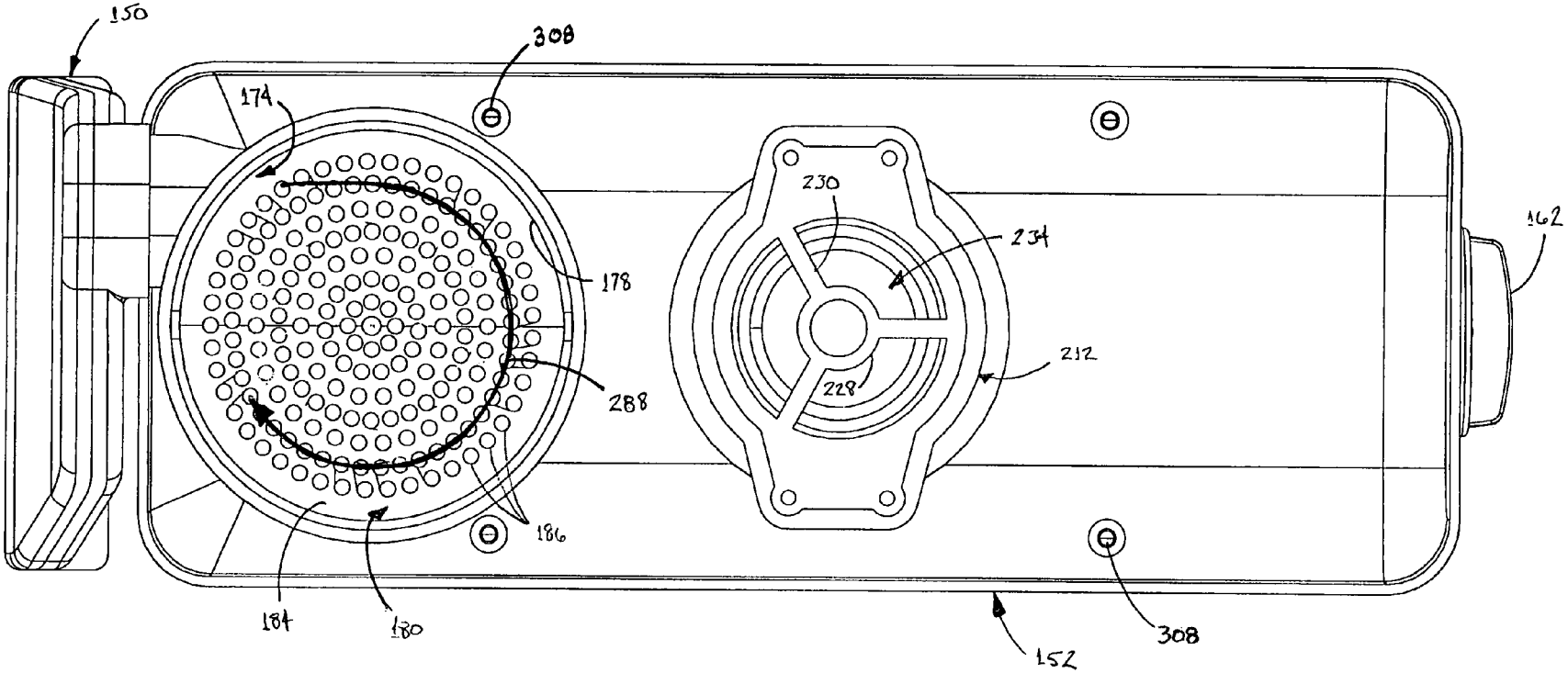
FIG. 14 is a top, plan view of the tank and pickup nozzle of FIG. 13, showing the relationship between the entrance chamber and the passage from the pickup nozzle in greater detail, and also showing the generally circular, swirling flow that is induced within the chamber by this relationship.
Figure 15:
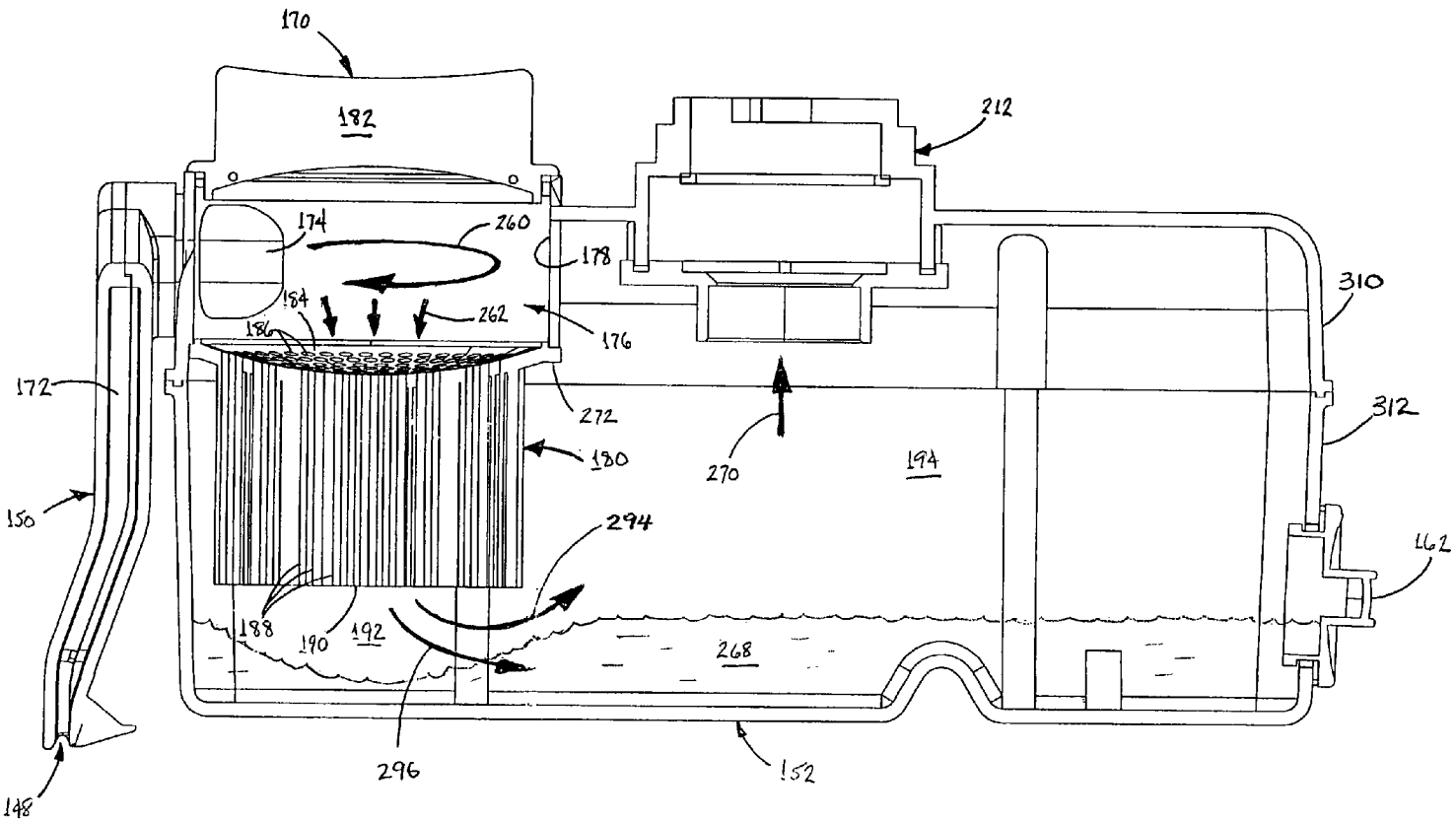
FIG. 15 is a longitudinal cross-sectional view of the pickup nozzle and collection tank of FIGS. 13-14, with the cap over the entrance chamber being in place, showing the flow path of the water and air as it passes from the pickup nozzle to the entrance chamber, and then downwardly through the separation cartridge into the main collection area of the tank.

As can be seen in FIGS. 13-14, the upper end 284 of the pickup nozzle 150 and the horizontal passage 174 that receives flow therefrom are offset laterally (to the right side in the embodiment that is illustrated) from the vertical axis of the cylindrical entry chamber 176. The flow of combined air and liquid thus enters the chamber in a generally tangential direction, as indicated by arrow 286, along the inside surface of the wall 178 of the chamber. The cylindrical wall 178 redirects the flow along a generally circular path as indicated by arrow 288, in essence inducing a "swirl" effect over the upper end of the liquid separation body 180. As can be seen in FIG. 15, the combined swirling action and downward draw created by the suction and gravity, as indicated by arrows 290, 292, cooperate with the downwardly concave upper surface 184 of the separation body 180 to distribute the flow over and across the multiple separation bores 186. It has been discovered that this action not only more evenly distributes the flow, but also increases the efficiency of air/liquid separation in the bores 186 as compared with arrangements where the flow is directed more-or-less directly or axially into the bores.

As can be seen with further reference to FIG. 15, the flow passes out of the bottom 190 of the separation body 180, into the area 192 of the collection tank beneath the separation body, from which point the materials follow more-or-less separate paths; as is indicated by arrow 294, the air follows a first path, depressing the surface of the liquid somewhat in the area 192 beneath the separator body and then entering the upper part of the main volume 194 of the collection tank; the flow of the heavier water or other liquid, as indicated by arrow 296, is directed to the lower part of the main volume 194 of the collection tank, where it accumulates in a layer 298 at the bottom of the tank. The lighter air is drawn off from over the layer of liquid, as indicated by arrow 300, and passes upwardly through the valve body 212 in a manner described above. The assembly is therefore able to separate the air and liquid in a highly efficient manner while maintaining strong flow/suction to effectively draw up liquid through the nozzle 150, with little or no liquid being passed through to the remote suction source.

Figure 16:
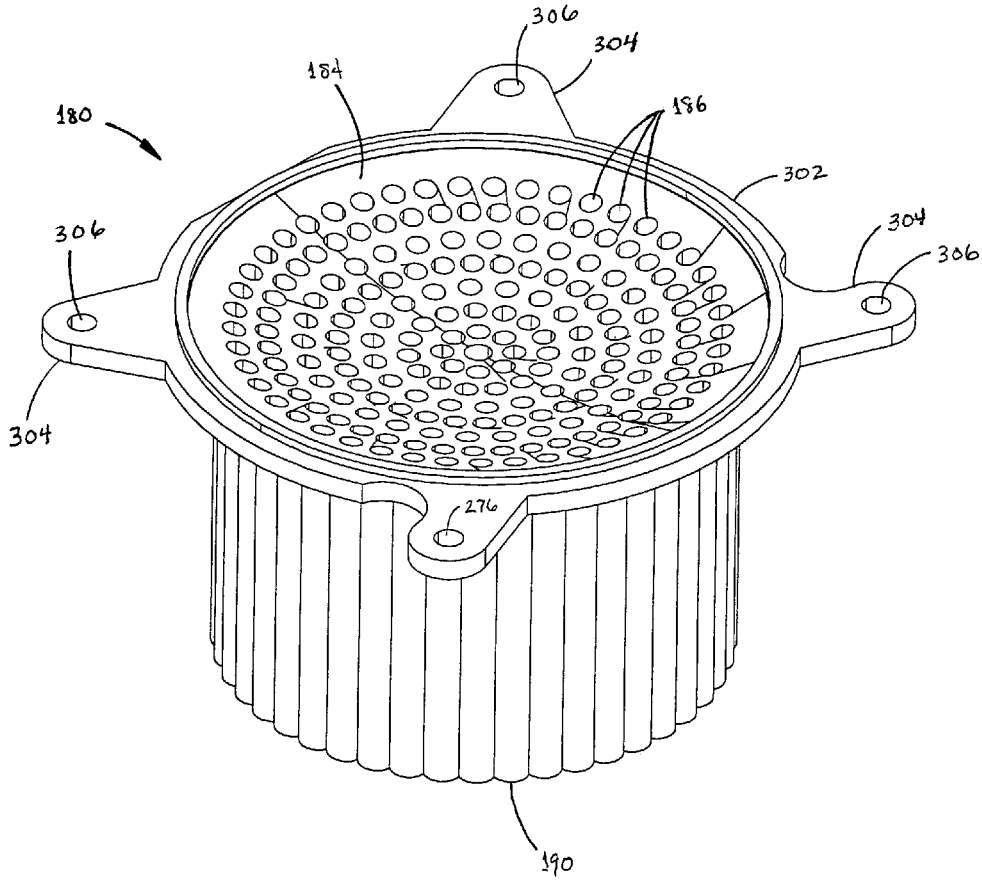
FIG. 16 is a perspective view of the separation cartridge of FIGS. 13-15, showing the multiple tube construction of the cartridge in greater detail.

FIG. 16 shows the structure of the liquid separation cartridge or body 180 in greater detail, in particular the concavely curved, dished upper surface of the body and the multiple bores 186 that extend downwardly therefrom. Although the dimensions and numbers of bores may vary depending on design factors, including factors relating to the suction source, the illustrated embodiment of the separation body suitably has a diameter (exclusive of the mounting flange) of about five centimeters, a vertical length of about four centimeters, and about one-hundred and ninety-two bores having a diameter of about two millimeters each, the foregoing dimensions are exemplary in nature, and are given by way of illustration and no limitation. The separation body (as with most of the other components of the assembly) is suitable formed of injection molded plastic.

As can be seen in FIG. 16, the liquid separation body 180 of the illustrated embodiment has a generally cartridge-like configuration, with a mounting flange 302 which seats against the bottom lip of the cylindrical wall 178 of the intake chamber 176 (see FIGS. 11 and 15) and mounts thereto by means of projecting ear portions 274 having bores 306 that receive screws or other fasteners. The liquid separation body may therefore be removed for cleaning if needed, for example, by removing screws 308 (see FIG. 14) and separating the upper and lower sections 310, 312 (see FIG. 15) of the collection tank and then demounting the separator body.

Figure 17:
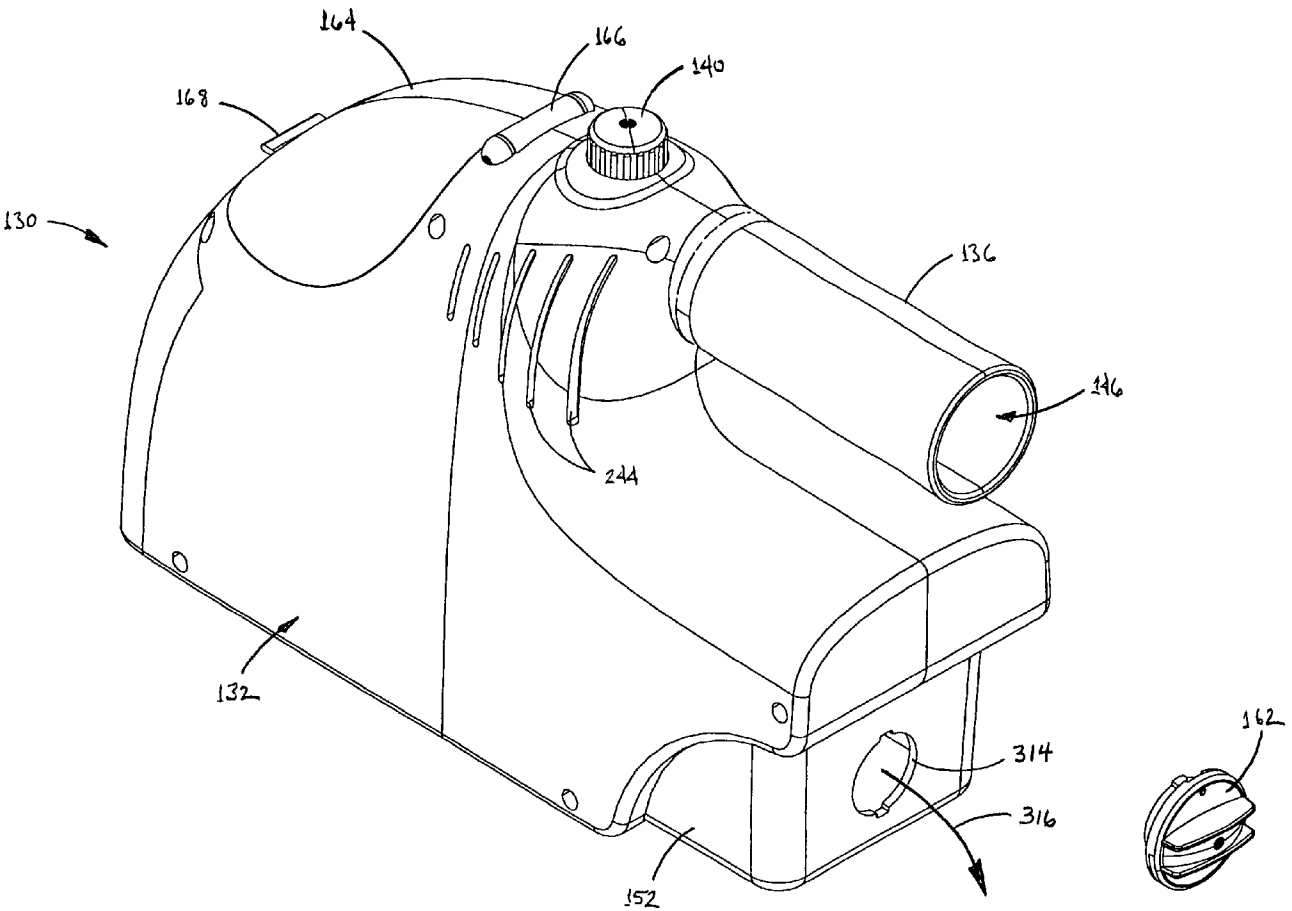
FIG. 17 is a second rear elevational view of the liquid separation suction nozzle assembly of FIGS. 7-9 showing the manner in which the end cap of the collection tank can be removed in order to dump the collected liquid from the tank.
Figure 18:
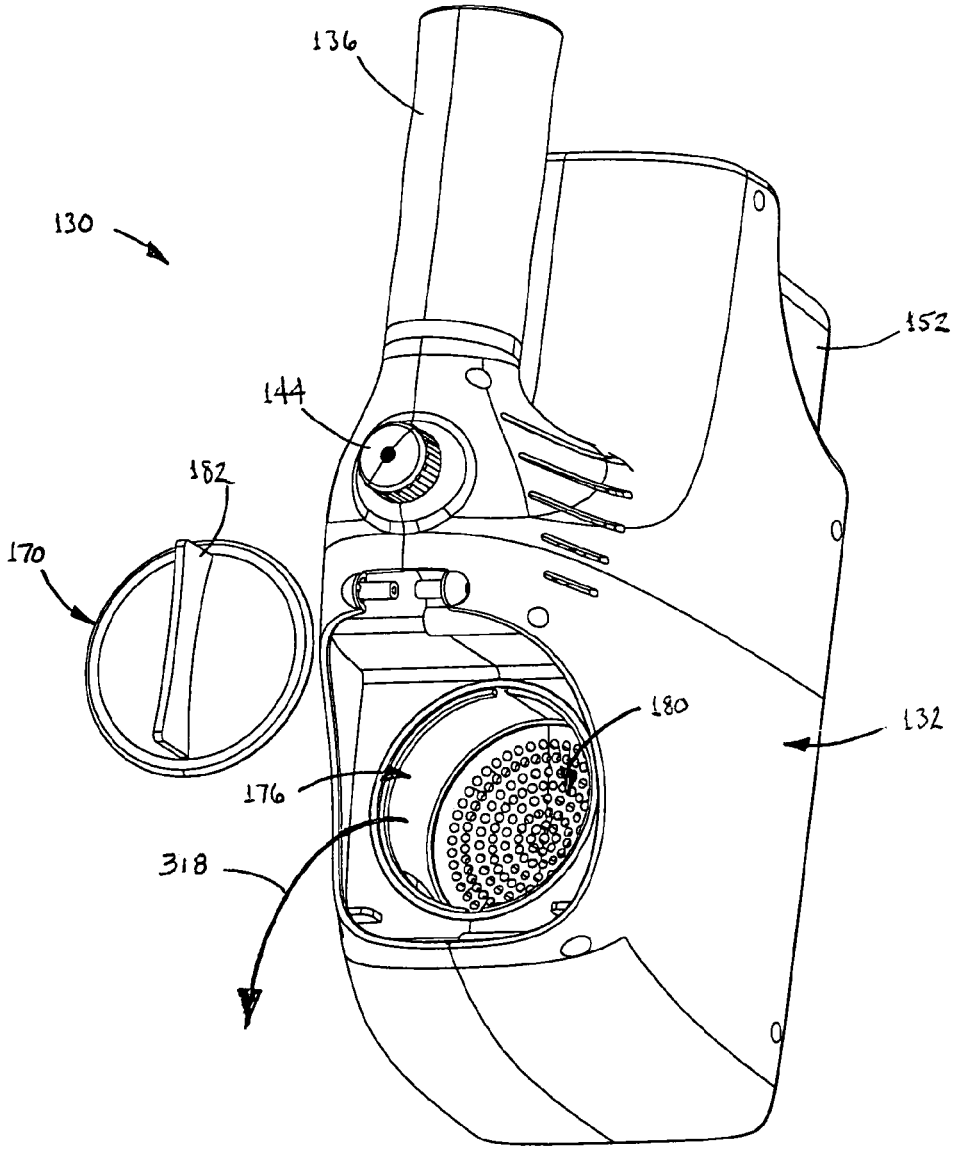
FIG. 18 is a second front perspective view of the liquid separation suction nozzle assembly of FIGS. 7-9, with the pivoting front cover removed for ease of illustration, showing the manner in which the top cap of the entry chamber can be removed to extract fibers and other collected solids from over the separation cartridge leading to the collection tank.

When removal of the spill or the liquid suction task has otherwise been completed (or when the collection tank becomes full, as described above), the liquid collection tank is emptied by simply removing drain plug 162 from the opening 314 at the rearward end of the tank, as indicated by arrow 316 in FIG. 17. Fibers, threads or other debris that may have accumulated over the top of the liquid separation body 180 can in turn be removed by simply releasing catch 168 and lifting cover 164, then removing cap 170 and dumping or fishing the debris out of chamber 176, as indicated by arrow 318 in FIG. 18 (please note that cover 164 is not shown in FIG. 18).

It will be appreciated that the advantage of improved liquid separation, achieved by employing a plurality of preferably tubular passages to restrict the flow into the collection area, will apply irrespective of the actuating mechanisms, valving, and other parts of the assembly. It will therefore be understood that this aspect of the invention may be applied to a wide range of wet nozzles, separators and other attachments and assemblies, in addition to the examples described above.

Also, as noted above, such assemblies may utilize self-contained suction sources, in addition to or in place of vacuum cleaners or other external sources as utilized in the exemplary embodiments of FIGS. 1-5.

It is to be recognized that various alterations, modifications, and/or additions may be introduced into the constructions and arrangements of parts described above without departing from the spirit or ambit of the present invention as defined by the appended claims.

What is claimed is:

1. An apparatus for drawing liquid from a floor or other surface utilizing a flow of air provided by a suction source, said apparatus comprising:

a liquid collection tank;

an intake opening in fluid communication with said collection tank, said intake opening being positionable proximate said floor or other surface;

means for establishing fluid communication between said collection tank and said suction source so that said flow of air is drawn in said intake opening and through said collection tank;

a plurality of liquid separation passages that restrict and divide said flow of air between said intake opening and said collection tank, so that said liquid is separated from said flow of air and collected in said tank prior to said flow of air reaching said suction source, said plurality of liquid separation passages comprising:

a plurality of elongate passages arranged in a bundle, said bundle having an intake end at which said flow of air and liquid enters said passages and a discharge end at which said flow of air exits said passages with said liquid having been separated therefrom; and means for introducing said flow of air at an indirect angle to openings of said liquid separation passages at said intake end of said bundle.

2. The apparatus of claim 1, wherein said means for establishing fluid communication between said collection tank and said suction source comprises:

means for establishing fluid communication between said collection tank and a remote suction source.

3. The apparatus of claim 2, wherein said means for establishing fluid communication between said collection tank and a remote suction source comprises:

means for establishing fluid communication between said collection tank and a hose leading to a household vacuum cleaner.

4. The apparatus of claim 1, wherein said means for introducing said flow of air at an indirect angle to said openings of said liquid separation passages comprises:

a plenum located at said intake end of said bundle; and an inlet passage that directs said flow of air into said plenum at an indirect angle to said openings of said liquid separation passages.

5. The apparatus of claim 4, wherein said plenum comprises:

a substantially cylindrical wall extending annularly about said intake end of said bundle of liquid separation passages, said inlet passage directing said flow of air in a substantially tangential direction against said cylindrical wall so that said flow of air swirls within said plenum at said openings of said liquid separation passages.

6. The apparatus of claim 4, wherein said discharge end of said bundle of liquid separation passages is located in an interior of said collection tank, so that liquid separated from said flow of air drops from said discharge end of said bundle into a lower portion of said tank of air in said flow of air rises into an upper portion of said tank.

7. The apparatus of claim 6, wherein said intake end of said bundle of liquid separation passages forms an upper end of said bundle and said discharge end of said bundle of liquid separation passages forms a lower end of said bundle, so that said flow of air enters said passages from said plenum and flows in a substantially downward direction therethrough.

8. The apparatus of claim 7, further comprising:

a nozzle member having said intake opening at a lower end and said inlet passage into said plenum at an upper end.

9. The apparatus of claim 6, wherein said means for establishing fluid communication between said tank and said suction source comprises:

a valve for selectively establishing fluid communication between said suction source and said upper portion of said collection tank.

10. The apparatus of claim 9, further comprising:

means for preventing liquid in said lower portion of said collection tank being drawn through said valve with said air as said tank fills with liquid.

11. The apparatus of claim 10, wherein said means for preventing liquid from being drawn through said valve as said tank fills with liquid comprises:

an outflow opening in said upper portion of said collection tank through which said air flows to said valve; and a float mounted in said collection tank so as to rise against and seal said outflow opening as said tank fills with liquid.

12. The apparatus of claim 9, further comprising:

means for supplying a supplementary flow of cooling air to said vacuum source when said valve is closed.

13. The apparatus of claim 12, wherein said means for supplying a supplementary flow of cooling air to said vacuum source comprises:

an inlet vent in fluid communication with said vacuum source on a downstream side of said valve.

14. The apparatus of claim 13, further comprising:

means for sealing said inlet vent so as to block said supplementary flow of cooling air when said valve is opened so as to apply said flow of air from said suction source to said collection tank.

15. The apparatus of claim 14, wherein said means for sealing said inlet vent so as to block said supplementary flow of cooling air comprises:

a secondary valve for closing said inlet vent; and a linkage operably interconnecting said actuating valve and said secondary valve so that said secondary valve closes simultaneously with opening of said actuating valve.

16. The apparatus of claim 15, wherein said linkage comprises:

a shaft having said actuating valve mounted at a first location thereon and said secondary valve mounted at a second location thereon; and means for selectively translating said shaft so as to move said actuating valve away from a valve opening of said suction passage and simultaneously move said secondary valve towards a valve opening of said inlet vent.

17. The apparatus of claim 16, wherein said means for selectively translating said shaft comprises:

an operating button mounted to said shaft that is selectively depressible under a finger of a user's hand.

18. An apparatus for drawing liquid from a floor or other surface utilizing a flow of air provided by a suction source, said apparatus comprising:

a liquid collection tank having upper and lower portions at forward and rearward ends;

a lift nozzle mounted at said forward end of said liquid collection tank, said lift nozzle comprising:

a slot-shaped intake opening that extends transversely of said collection tank at a lower end of said lifting nozzle;

a generally upwardly-extending flow passage in fluid communication with said intake opening; and a generally rearwardly-extending flow passage in fluid communication with said upwardly-extending flow passage at an upper end of said lifting nozzle;

a plenum chamber mounted in said upper portion of said collection tank proximate said forward end thereof, said plenum chamber comprising:

a generally cylindrical wall defining upper and lower openings;

a removable cap mounted over said upper opening; and an inlet opening in fluid communication with said rearwardly-extending flow passage of said lift nozzle, said inlet opening being aligned in a generally tangential direction at said cylindrical wall of said plenum chamber;

a liquid separation body mounted under said lower opening of said plenum chamber, said liquid separation body comprising:

a generally downwardly concave upper end that forms a bottom to said plenum chamber;

a lower end that is located in an interior volume of said collection tank proximate said lower portion thereof; and a plurality of elongate liquid separation passages having entry openings at said upper end of said liquid separation body and discharge ends at said lower end of said body;

a suction opening in said upper portion of said liquid collection tank; and a valve assembly that selectively establishes fluid communication between said suction opening in said upper portion of said tank.

19. The apparatus of claim 18, further comprising:

means for preventing liquid in said collection tank from being drawn out through said suction opening as said tank becomes full.

20. The apparatus of claim 19, wherein said means for preventing liquid from being drawn out through said suction opening in said upper portion of said collection tank as said tank becomes full comprises:

a float valve mounted in said collection tank that rises against said suction opening in response to said tank filling with liquid.

* * * * *